US006691881B1

(12) United States Patent
Masse

(10) Patent No.: US 6,691,881 B1
(45) Date of Patent: Feb. 17, 2004

(54) COMBINED LOCOMOTIVE AND CRANE CONSTRUCTION

(76) Inventor: Aaron A. Masse, P.O. Box 27A, RR6, Edmonton, Alberta Province (CA), T5B 4K3

( * ) Notice: Subject to any disclaimer, the term of this patent is extended or adjusted under 35 U.S.C. 154(b) by 79 days.

(21) Appl. No.: 10/050,303

(22) Filed: Jan. 16, 2002

(51) Int. Cl.[7] ..... B66C 23/38
(52) U.S. Cl. ..... 212/180; 212/231
(58) Field of Search ..... 212/180, 231

(56) References Cited

U.S. PATENT DOCUMENTS

| | | | | |
|---|---|---|---|---|
| 2,642,007 | A | * | 6/1953 | Fox |
| 3,120,819 | A | * | 2/1964 | Gammie |
| 3,263,628 | A | * | 8/1966 | Grove et al. |
| 3,314,374 | A | * | 4/1967 | Moorehead et al. |
| 3,338,426 | A | | 8/1967 | Grove |
| 3,344,747 | A | * | 10/1967 | Keller |
| 3,349,717 | A | * | 10/1967 | Blix et al. |
| 3,391,025 | A | * | 7/1968 | Foxx et al. |
| 3,566,796 | A | * | 3/1971 | Herrick ..... 104/2 |
| 4,128,180 | A | | 12/1978 | Mellious ..... 214/44 A |
| 4,195,741 | A | | 4/1980 | Newman ..... 212/66 |
| 4,214,665 | A | | 7/1980 | Newman ..... 52/726 |
| 4,234,287 | A | * | 11/1980 | Lassig et al. ..... 414/542 |
| 4,263,797 | A | * | 4/1981 | Cooper ..... 72/40 |
| 4,705,450 | A | * | 11/1987 | Gano ..... 414/687 |
| 4,708,066 | A | * | 11/1987 | Heckman ..... 105/215.2 |
| 4,828,452 | A | * | 5/1989 | Bolitho ..... 414/718 |
| 5,016,544 | A | * | 5/1991 | Woollam ..... 105/215.2 |
| 5,066,188 | A | | 11/1991 | Bush ..... 414/339 |
| 5,100,278 | A | | 3/1992 | Westlake ..... 414/339 |
| 5,103,740 | A | * | 4/1992 | Maase ..... 105/72.2 |
| 5,191,838 | A | * | 3/1993 | Hansen ..... 104/2 |
| 5,518,128 | A | | 5/1996 | Kroll et al. ..... 212/196 |
| 5,628,606 | A | | 5/1997 | Hertzog et al. ..... 414/339 |
| 5,762,464 | A | | 6/1998 | Hertelendi ..... 414/486 |
| 5,904,098 | A | | 5/1999 | Theurer et al. ..... 104/2 |

* cited by examiner

*Primary Examiner*—Thomas J. Brahan
(74) *Attorney, Agent, or Firm*—Sturm & Fix LLP

(57) ABSTRACT

A combined locomotive and crane construction (10) including a locomotive unit (11) having an elongated undercarriage member (21) provided with a front section (22) and a rear section (23) wherein the front section (22) provides a support platform for a locomotive engine (20) and a control cab (25) and the rear section (23) provides a support platform for a crane unit (12) having an extensible crane boom (34) that is rotatably disposed over the rear section 23 of the undercarriage member (21).

5 Claims, 2 Drawing Sheets

COMBINED LOCOMOTIVE AND CRANE CONSTRUCTION

BACKGROUND OF THE INVENTION

CROSS REFERENCE TO RELATED APPLICATIONS

Not applicable.

1. Field of the Invention

The present invention relates to the field of railroad cars in general and in particular to a combined locomotive and crane.

2. Description of Related Art

As can be seen by reference to the following U.S. Pat. Nos. 5,518,128; 4,195,741; 4,214,665; 3,338,426; and 5,100,278, the prior art is replete with myriad and diverse motorized crane constructions.

While all of the aforementioned prior art constructions are more than adequate for the basic purpose and function for which they have been specifically designed, they are uniformly deficient with respect to their failure to provide a simple, efficient, and practical arrangement wherein a crane is integrally incorporated into a locomotive.

As most railway personnel are aware, while a motorized crane has the ability to pull a limited number of railway cars, it can only do so at lower track speeds. However, a locomotive can pull or push a large number of railway cars at posted track speeds with no problem at all.

As a consequence of the foregoing situation, there has existed a longstanding and unfulfilled need in the railway system for a new and improved combined locomotive and construction thereby eliminating the need for a separate underpowered motorized railway crane; and, the provision of such an arrangement is the stated objective of the present invention.

BRIEF SUMMARY OF THE INVENTION

Briefly stated, the combined locomotive and crane construction that forms the basis of the present invention comprises in general the incorporation of mechanized crane unit into a locomotive unit so that the crane unit and locomotive unit are wedded together as an integral construction.

As will be explained in greater detail further on in the specification, the locomotive unit is provided with an elongated undercarriage member having a forward section that forms a support platform for a locomotive engine that drives the front and rear wheel carriages of the undercarriage member; and, the rear section of the undercarriage member forms a support platform for a mechanized crane member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
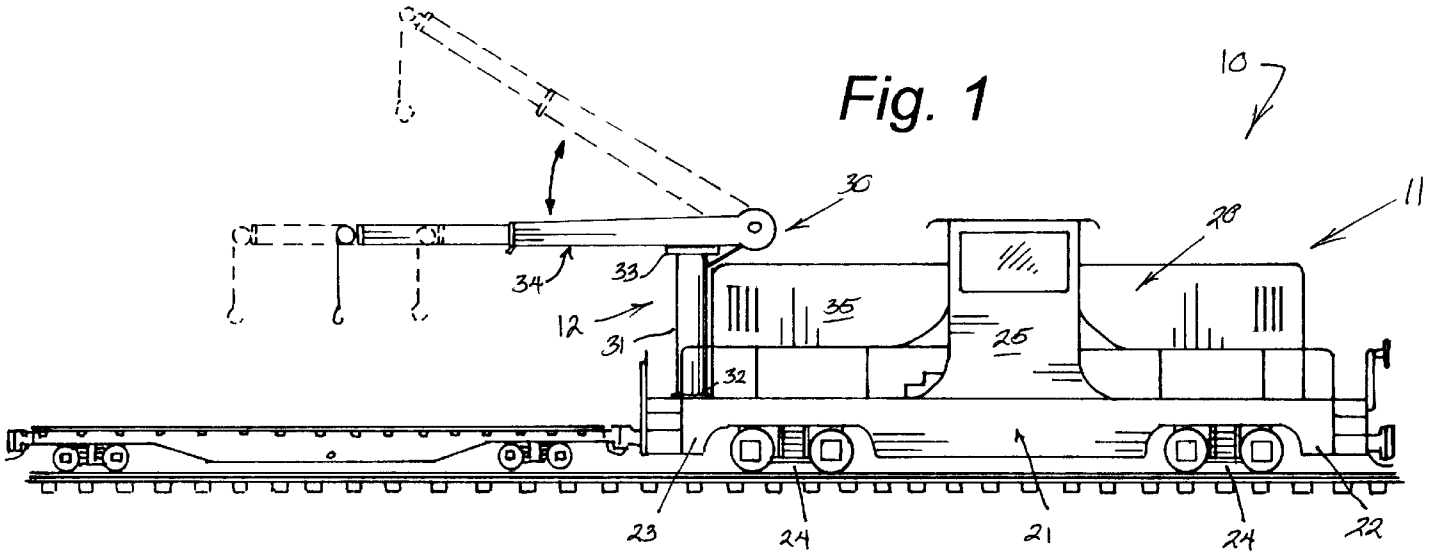
FIG. 1 is a side elevation view of one version of the combined locomotive and crane construction that forms the basis of the present invention.

As can be seen by reference to the drawings, and in particular to FIG. 1, the combined locomotive and crane construction that forms the basis of the present invention is designated generally by the reference number 10. The construction 10 comprises in general a locomotive unit 11 and a crane unit 12 that are wedded together into an integral construction. These units will now be described in seriatim fashion.

Figure 3:
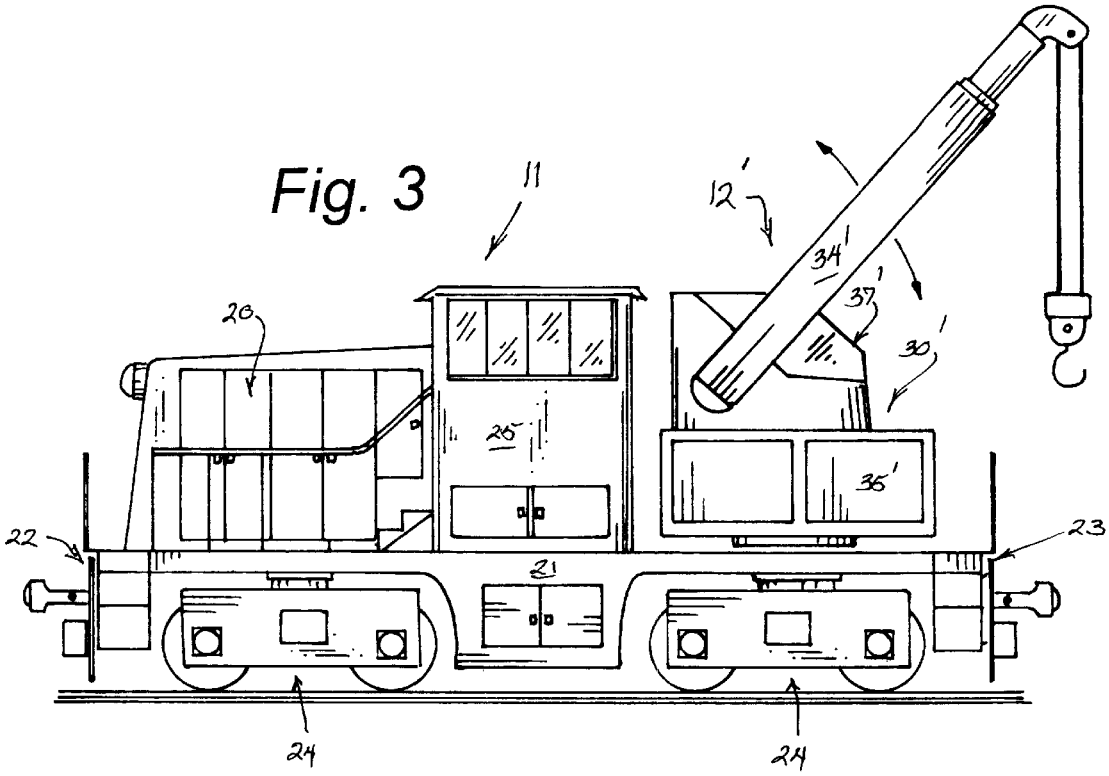
FIG. 3 is a side elevation view of the combined construction.

As can be seen by reference to FIGS. 1 and 3, in both versions of the preferred embodiment, the locomotive unit 11 comprises a locomotive engine 20 mounted on an elongated undercarriage member 21 having a front section 22 and a rear section 23 provided with wheel carriages 24 powered by the locomotive engine 20 in the conventional fashion; wherein, the front section 22 of the undercarriage member 21 forms a support platform for the locomotive engine 20 and the locomotive control cab 25.

In addition, the rear section 23 of the elongated carriage member 21 forms a support platform for the crane units 12 12' in both versions of the preferred embodiments as will be explained presently.

Figure 2:
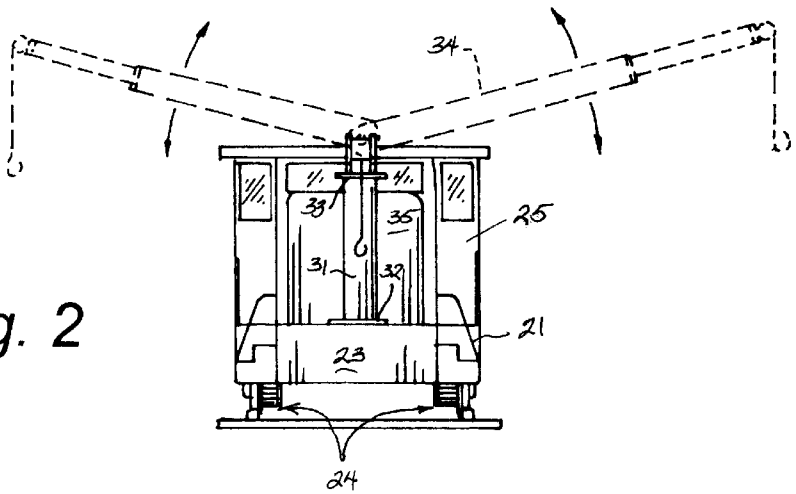
FIG. 2 is an end elevation view of the combined construction.

In the first version of the preferred embodiment depicted in FIGS. 1 and 2, it can be seen that the crane unit 12 comprises in general a boom crane member 30 having a central support column 31 having a lower end 32 mounted on the rear section 23 of the elongated undercarriage member 21 and having an upper end 33 equipped with an extensible crane boom 34 wherein the crane boom 34 and/or the central support column 31 are rotatably disposed relative to the undercarriage member 21 and to one another.

In addition, the extensible crane boom 34 is angularly adjustable relative to the support column 31 and the crane unit 12 is powered by a crane motor mechanism 35 likewise mounted on the rear section 23 of the undercarriage member 21 adjacent to the locomotive control cab 25.

In this particular version of the preferred embodiment, the operation of the crane member 30 is controlled via conventional control means (not shown) mounted in the control cab 25 of the locomotive unit 11.

Figure 4:
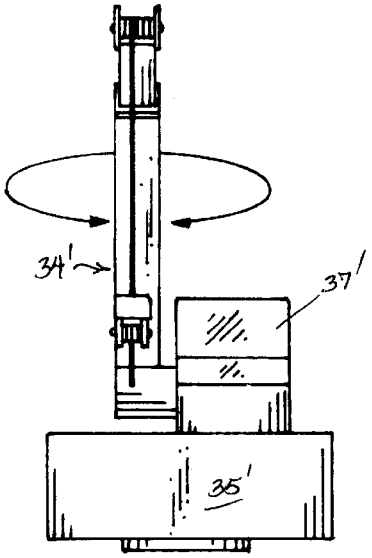
FIG. 4 is an isolated end elevation view of the crane unit of the second version.

Turning now to FIGS. 3 and 4, it can be seen that in the second version of the preferred embodiment, the crane unit 12' comprises an independently operated crane member 30 having a crane motor mechanism 35' rotatably mounted on the rear section 23 of the elongated undercarriage member 21; wherein, the motor mechanism 35' forms a crane control cabin 37' which in turn supports an extensible crane boom 34'; and, wherein the operation of the crane boom 34' is controlled independently of the locomotive control cab 25 by a crane operator (not shown) within the crane control cabin 37'.

At this juncture, it should be appreciated that the crane unit 12 may comprises any conventional type of the crane member 30 such as stiff boom cranes, knuckle boom cranes and hydraulic or cable cranes or the like in keeping with the teachings of this invention as long as the crane unit 12 is mounted behind the locomotive engine 20 on the same elongated undercarriage member 21 that is powered by the locomotive engine.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extend of the breadth and scope of the appended claims.

I claim:

1. A combined locomotive and crane construction consisting of locomotive unit including an undercarriage member having a front section provided with a coupler, a rear section provided with a coupler locomotive engine supported on the front section of the undercarriage member; wherein the undercarriage member is provided with wheel assemblies in constant contact with a railroad track during travel, and a control cab disposed intermediate the front and rear sections of the undercarriage member; and, a crane unit including an extensible crane boom provided with means for rotatably supporting the extensible crane boom on the rear section of the undercarriage member; and further comprises a support column having an upper end rotatably and angularly associated with the extensible crane boom and a lower end operatively connected to rear section of the undercarriage member wherein, the locomotive unit further includes a locomotive control cab disposed intermediate the locomotive engine and the crane unit; and, wherein, the crane unit further comprises a crane control cab forming a support base for said extensible crane boom wherein, said crane control cab rests on the rear section of the undercarriage member intermediate the crane boom and the control cab of the locomotive.

2. The combined construction as in claim 1; wherein, the crane unit further comprises a crane motor mechanism disposed intermediate the extensible crane boom and the locomotive control cab.

3. The combined construction as in claim 2; wherein, the extensible crane boom is supported by the crane control cab.

4. The combined construction as in claim 3; wherein, the crane motor mechanism is contained within the crane control cab.

5. The combined construction as in claim 4; wherein, the operation of the extensible crane boom is controlled from within the crane control cab.

* * * * *